US008007061B2

(12) United States Patent
Song

(10) Patent No.: US 8,007,061 B2
(45) Date of Patent: Aug. 30, 2011

(54) STORAGE PANEL GUIDING DEVICE WITH A MAGNETIC DAMPER

(75) Inventor: Jung Sik Song, Seoul (KR)

(73) Assignee: Medison Co., Ltd., Hongchun-gun (KR)

( * ) Notice: Subject to any disclaimer, the term of this patent is extended or adjusted under 35 U.S.C. 154(b) by 381 days.

(21) Appl. No.: 11/877,309

(22) Filed: Oct. 23, 2007

(65) Prior Publication Data

US 2008/0093960 A1 Apr. 24, 2008

(30) Foreign Application Priority Data

Oct. 23, 2006 (KR) ..... 10-2006-0102712

(51) Int. Cl.
*A47B 88/00* (2006.01)

(52) U.S. Cl. ..... 312/334.8; 248/118; 248/206.5; 248/309.4; 248/118.1; 108/143

(58) Field of Classification Search ..... 248/683, 248/118, 118.1, 118.5, 206.5, 309.4; 312/334.8, 312/334.7, 208.1; 108/143
See application file for complete search history.

(56) References Cited

U.S. PATENT DOCUMENTS 3,441,331 A * 4/1969 Kesling ..... 312/334.16
4,337,709 A * 7/1982 Nicholson ..... 108/33
4,912,727 A * 3/1990 Schubert ..... 312/334.8
4,948,208 A * 8/1990 Schubert ..... 312/334.16
7,367,697 B2 * 5/2008 George ..... 362/396
2005/0156085 A1 * 7/2005 Radovan ..... 248/110
2007/0131830 A1 * 6/2007 Brennan et al. ..... 248/206.5

FOREIGN PATENT DOCUMENTS

JP 2006-9367 1/2006
JP 2006-141457 6/2006

OTHER PUBLICATIONS

The Webster Dictionary, third edition, copyright 2005 by Houghton Mifflin Company, Boston.*

* cited by examiner

*Primary Examiner* — Terrell McKinnon
*Assistant Examiner* — Michael McDuffie
(74) *Attorney, Agent, or Firm* — Oblon, Spivak, McClelland, Maier & Neustadt, L.L.P.

(57) ABSTRACT

Embodiments of the present invention may provide a storage panel guiding device, which is configured to dampen movement of a storage panel movement using magnetic attractive force to thereby reduce damper friction. The storage panel guiding device of the present invention comprises the following: a magnetic damper including a first magnetic body, a second magnetic body and a thin plate interposed therebetween; a storage panel to which the first magnetic body is attached; a guide panel to which the second magnetic body is attached; a slide rail having a slot in which the guide panel can move; and a storage case accommodating the magnetic damper, the storage panel and the guide panel.

8 Claims, 5 Drawing Sheets

STORAGE PANEL GUIDING DEVICE WITH A MAGNETIC DAMPER

The present application claims priority from Korean Patent Application No. 10-2006-0102712 filed on Oct. 23, 2006, the entire subject matter of which is incorporated herein by reference.

BACKGROUND

1. Field

The present invention generally relates to a storage panel guiding device for ultrasonic diagnostic apparatus, and more particularly to a storage panel guiding device with a magnetic damper configured to prevent a panel from sliding and derailing out of guide rails.

2. Background

An ultrasonic diagnostic apparatus is widely used to diagnose a subject by visualizing a portion of the subject's body. Conventionally, an ultrasonic diagnostic apparatus can be stored in a storage case. A storage panel is movable in and out of the storage case, thereby allowing the ultrasonic diagnostic apparatus to be removably accommodated. Especially, in a storage panel for an ultrasonic diagnostic apparatus, when a storage panel slides to an undesired position, a user feels burdened and can even make a mistake. Also, if an impact is applied to a precise ultrasonic diagnostic apparatus, then the apparatus may malfunction. The slide movement and sudden stop of the storage panel can make such an impact. Therefore, a device for guiding the storage panel, which can effectively dampen the movement of the storage panel, is needed.

Hereinafter, a prior art storage panel guiding device will be described with reference to FIGS. 1 to 3.

FIG. 1 is a perspective view of a prior art storage panel guiding device having a wheel. FIG. 2 is a cross-sectional top view of the storage panel guiding device shown in FIG. 1. FIG. 3 is a cross-sectional lateral view of the storage panel guiding device shown in FIG. 1

In the storage panel guiding device shown in FIGS. 1 to 3, a wheel is equipped in the storage panel for a smooth movement. As shown in FIG. 1, guide rails 20 are attached on two lateral sides of a storage panel 10. They are engaged to slide rails 30 provided in the storage case (not shown). A wheel 21 is attached to the guide rail 20. A slot 32 guiding the wheel 21 is formed in the slide rail 30. The wheel 21 and the slot 32 allow the storage panel to move smoothly. A stopper 33 is coupled to an end of the slide rail 30. The stopper prevents the storage panel from being completely derailed from the storage case. As shown in FIG. 2, when the wheel 21 is brought into contact with the stopper 33, the wheel 21 and the storage panel 10 cannot move.

A storage panel guiding device shown in FIG. 3 has an inclined surface 34 at the end of the slide rail 30 instead of the stopper 33. The wheel 21 may stop at the ramp 34 when contacted thereto. If a user wants to put the storage panel completely out of the storage case, then the user must pull the storage panel 10 outward.

In the storage panel guiding device shown in FIGS. 1 to 3, the wheel can roll or slide continuously, although the user has stopped the storage panel. Especially, the storage panel 10 for a medical instrument such as an ultrasonic diagnostic apparatus should be placed in a predetermined position. However, non-stationary movement of the storage panel can make the user feel very cumbersome.

Therefore, there is a need to provide a storage panel guiding device, which has a damping mechanism without abrasion to enhance durability and which has a simple structure to reduce costs.

BRIEF DESCRIPTION OF THE DRAWINGS

Arrangements and embodiments may be described in detail with reference to the following drawings in which like reference numerals refer to like elements and wherein.

DETAILED DESCRIPTION OF THE PRESENT INVENTION

A detailed description may be provided with reference to the accompanying drawings. One of ordinary skill in the art may realize that the following description is illustrative only and is not in any way limiting. Other embodiments of the present invention may readily suggest themselves to such skilled persons having the benefit of this disclosure.

Figure 1:
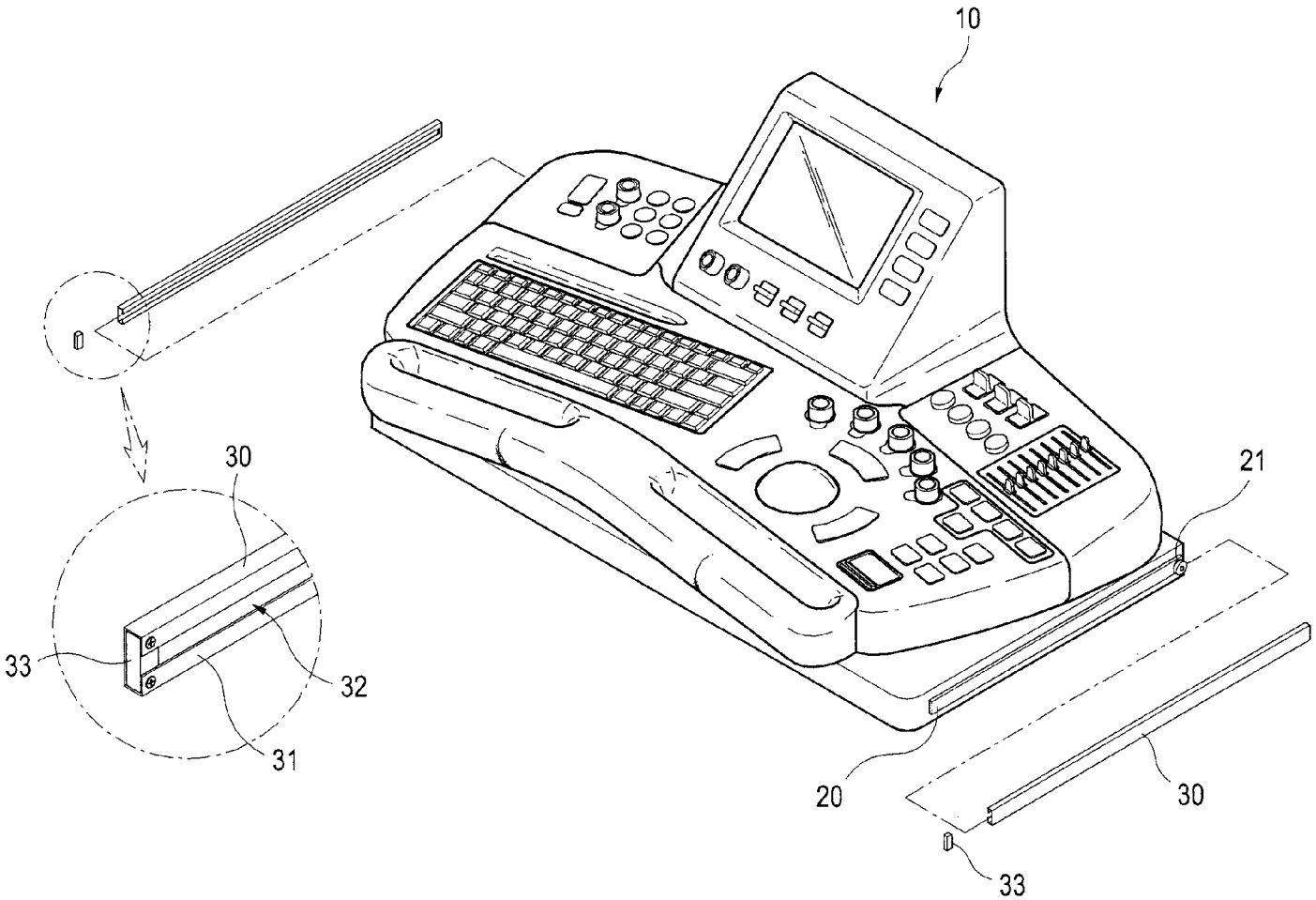
FIG. 1 PRIOR ART
FIG. 1 is a perspective view of a prior art storage panel guiding device having a wheel.
Figure 2:
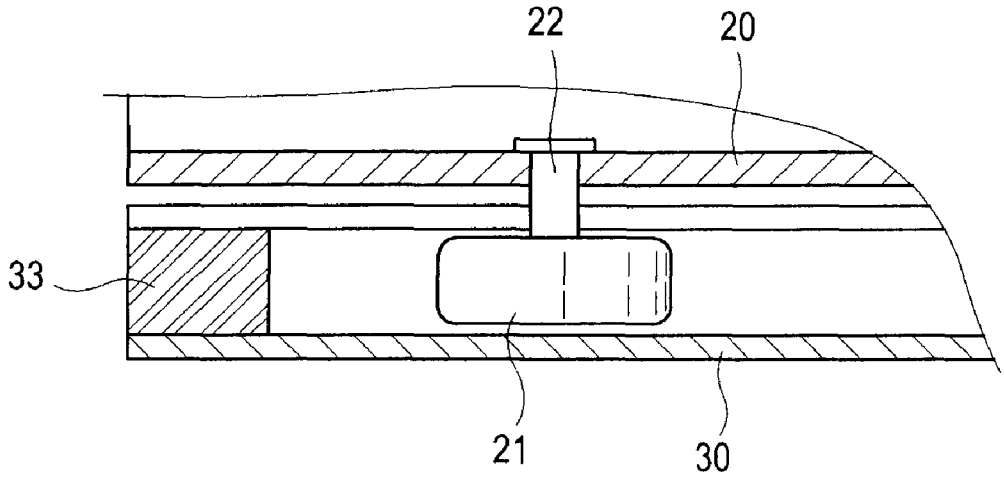
FIG. 2 PRIOR ART
FIG. 2 is a cross-sectional top view of the storage panel guiding device shown in FIG. 1.
Figure 3:
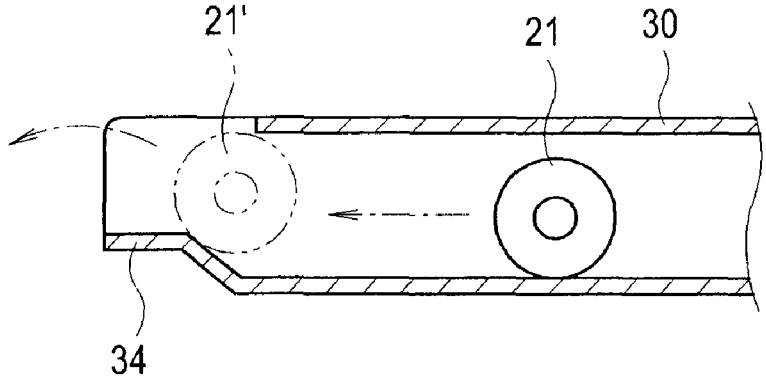
FIG. 3 PRIOR ART
FIG. 3 is a cross-sectional lateral view of the storage panel guiding device shown in FIG. 1.
Figure 4:
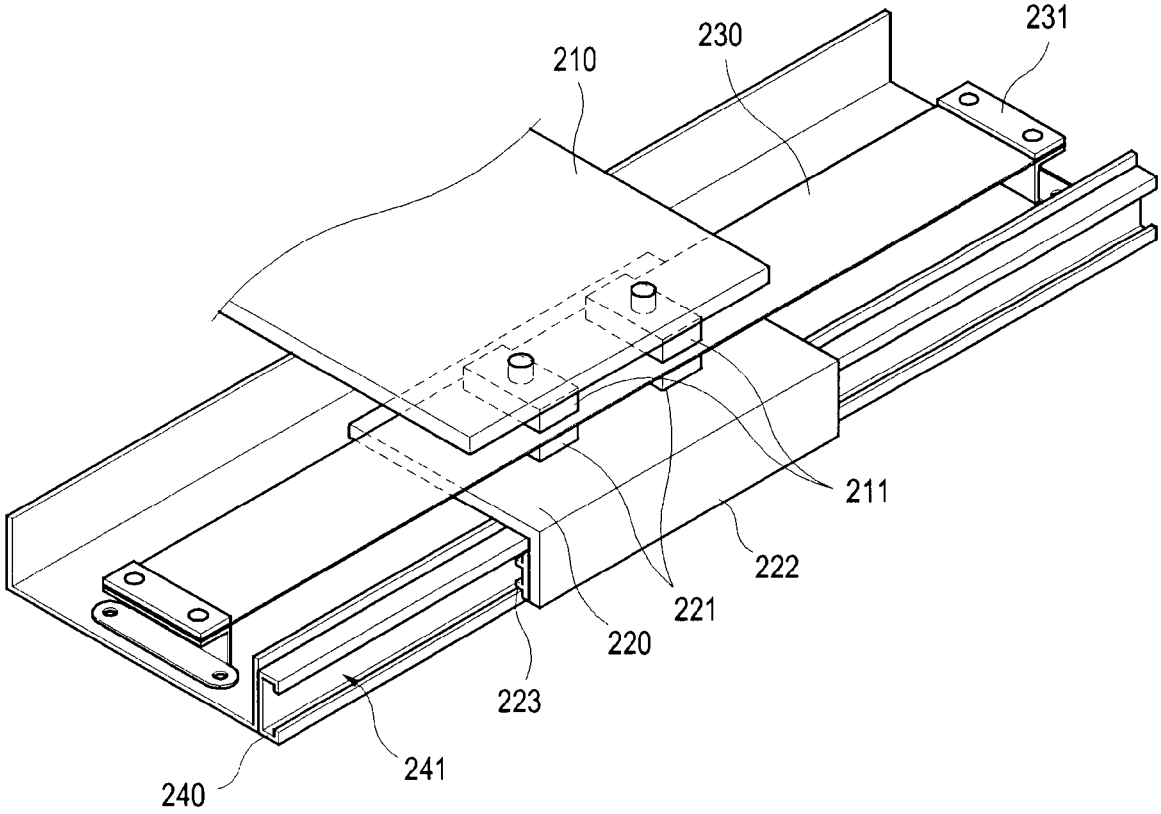
FIG. 4 is a perspective view of a storage panel guiding device with a magnetic damper constructed in accordance with a first embodiment of the present invention.
Figure 5:
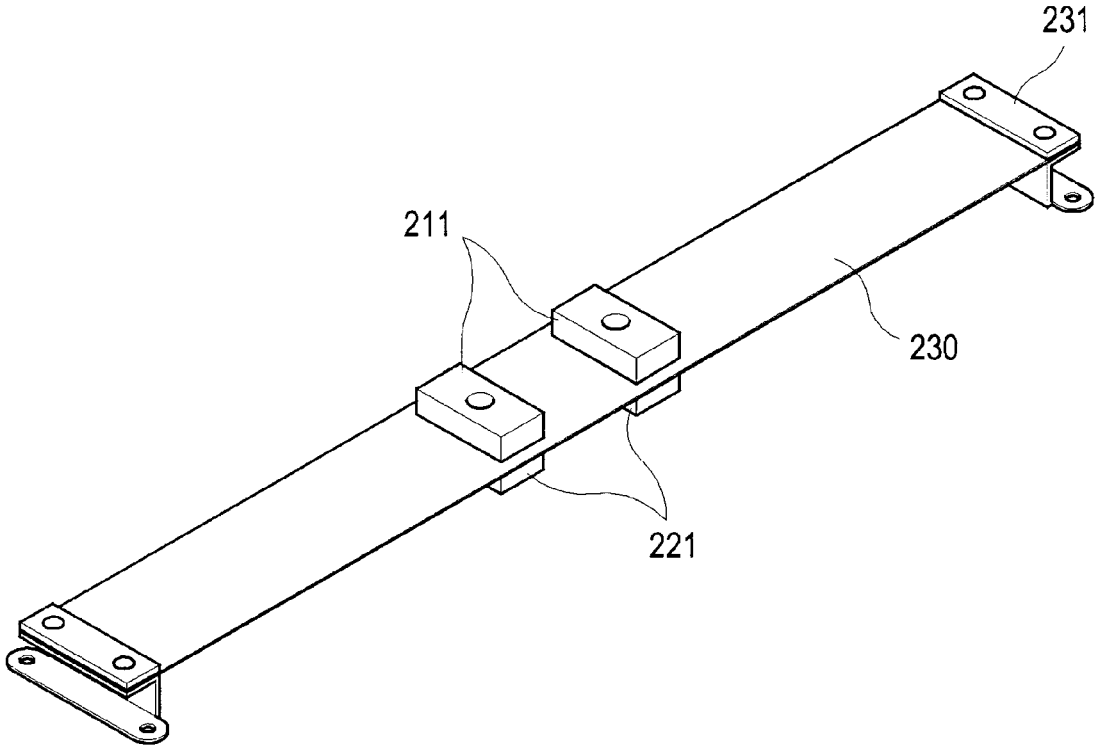
FIG. 5 is a perspective view of the magnetic damper of the storage panel guiding device shown in FIG. 4.

FIG. 4 is a perspective view of a storage panel guiding device with a magnetic damper, which is constructed in accordance with a first embodiment of the present invention. FIG. 5 is a perspective view of the magnetic damper of the storage panel guiding device shown in FIG. 4. In this embodiment, a storage panel guiding device includes: a storage panel 210; a guide panel 220 disposed under the storage panel 210; a magnetic damper; and a slide rail 240. An object to be stored is placed on the storage panel 210.

A magnetic damper includes: a first magnetic body 211; a second magnetic body 221; and the thin plate 230 interposed between the first and second magnetic bodies 211, 221. The first magnetic body 211 is attached to a bottom surface of the storage panel 210. The thin plate 230 is fixed to the storage case. The second magnetic body 221 is attached to a top surface of the guide panel 220 facing the first magnetic body 211 through attractive force. The thin plate 230 is disposed so as to be parallel to the moving direction of the storage panel 210. The slide rail 240 is provided in a storage case (not shown). A slot 241 is formed on the slide rail 240. A guide plate 222 is orthogonally extended from the guide panel 220. A guide 223 protrudes on the guide plate 222. The slot 241 faces the guide plate 222. The guide 223 protruding on the guide on the guide plate 222 is inserted into the slot 241. The thin plate 230 is fixed to the storage case by a bracket 231.

Figure 6:
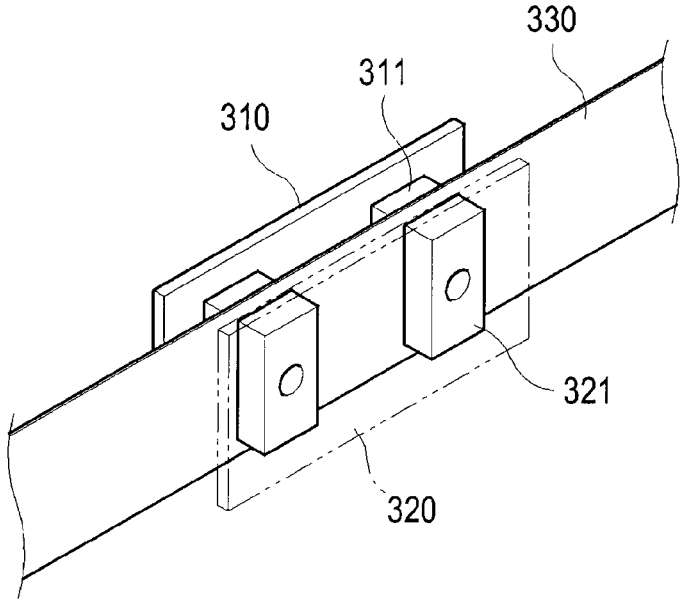
FIG. 6 is a perspective view of a magnetic damper of a storage panel guiding device constructed in accordance with a second embodiment of the present invention.

FIG. 6 is a perspective view of a magnetic damper of a storage panel guiding device constructed in accordance with a second embodiment of the present invention. In this embodiment, a magnetic damper includes: a first magnetic body 311; a thin plate 330; and a second magnetic body 321.

The first magnetic body 311 is attached to a lateral surface of a storage panel 310. The second magnetic body 321 is attached to a lateral surface of a guide panel 320. The thin plate 330 is fixed to the storage case.

Figure 7:
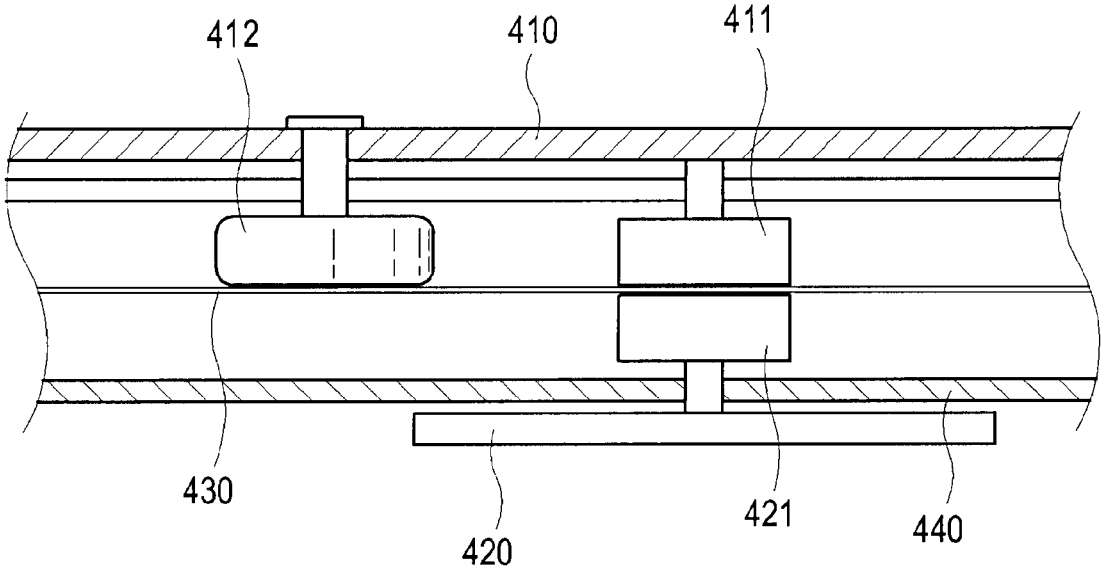
FIG. 7 is a top view of a storage panel guiding device with a magnetic damper constructed in accordance with a third embodiment of the present invention.

FIG. 7 is a top view of a storage panel guiding device having magnetic damper constructed in accordance with a third embodiment of the present invention. In this embodiment, a storage panel guiding device includes a storage panel 410, a guide panel 420, a magnetic damper, a wheel 412 and a slide rail 440. An object to be stored is placed on the storage panel 410.

The magnetic damper includes a first magnetic body 411, a second magnetic body 421 and a thin plate 430 interposed therebetween. The first magnetic body 411 is attached to a lateral surface of the storage panel 410. The second magnetic body 421 is attached to a guide panel 420 facing the first magnetic body 411 with attractive force. The thin plate 430 is disposed to be parallel to the storage panel 410 moving direction. The storage panel 410 has a wheel 412. The slide rail 440 is disposed to the storage panel 410 and the guide panel 420. The slide rail 440 accommodates the wheel 412 and the magnetic damper. Thus, the magnetic damper supplies a constant friction force to thereby dampen the movement of the storage panel 410.

In all embodiments of the present invention, the first and second magnetic bodies can have polarity. They must be situated in such way that magnetic attractive force acts therebetween. For example, if the first and second magnetic bodies are configured as permanent magnets, then they are situated in such a way that different poles are opposed to each other.

Hereinafter, the operation of the present invention will now be described with reference to FIGS. 4 and 5.

The thin plate 230 is fixed on the storage case by the bracket 231 with fixing means (e.g., screw, rivet, bond and the like). The thin plate 230 is interposed between the first magnetic body 211 and the second magnetic body 221. The attractive force acts between the first and second magnetic bodies 211 and 221 through the thin plate. Therefore, the thin plate 230 prevents the first magnetic body 211 from being directly stuck to the second magnetic body 221. When a user pulls the storage panel 210, the storage panel 210 is moved outwardly from the storage case. Thereafter, if a user stops pulling the storage panel 210, then the friction forces acting on the thin plate 230 with the magnetic bodies 211 and 221 and the magnetic attractive force, which acts between the magnetic bodies 211 and 221, dampen the movement of the storage panel 210. Thus, the storage panel 210 can stop without any slide.

The storage panel guiding device with magnetic damper of the present invention can effectively dampen the sliding movement of the storage panel.

Further, the magnetic bodies and the thin plate can be disposed horizontally or vertically. Furthermore, they can be applied to a common storage panel guiding device in order to dampen a sliding movement of the storage panel.

Moreover, when the present invention is used for guiding an ultrasonic diagnostic apparatus, the ultrasonic diagnostic apparatus does not move or slide unless the user pulls or pushes the storage panel. Thus, the user can concentrate on diagnosis. Further, since the movement of the storage panel is effectively dampened, a slight impact can be applied to the precise ultrasonic diagnostic apparatus. In addition, since the apparatus can be stopped in a predetermined position, the present invention is very useful to the storage panel guiding device, on which the ultrasonic diagnostic apparatus is placed.

Embodiments of the present invention may provide a storage panel guiding device having a magnetic damper. The movement of the storage panel can be dampened by the magnetic damper having magnetic bodies and a thin plate. Therefore, an object can be placed on the storage panel with slight sliding movement. Further, durability is enhanced due to a low friction of the damper.

A storage panel guiding device having magnetic device may be provided. A storage panel guiding device of the present invention may comprise: a magnetic damper including a first magnetic body, a second magnetic body opposed to the first magnetic body, and a thin plate interposed therebetween, wherein a magnetic attractive force acts between the first and second magnetic bodies; a storage panel to which the first magnetic body is attached; a guide panel to which the second magnetic body is attached; a slide rail having a slot in which the guide panel moves; and a storage case for accommodating the magnetic damper, the storage panel and the guide panel, wherein the slide rail is provided in the storage case.

The first magnetic body, the thin plate and the second magnetic body can be vertically disposed. Further, the first magnetic body is attached to a bottom surface of the storage panel and the second magnetic body is attached to an opposed top surface of the guide panel. The thin plate is fixed to the storage case. Alternatively, the first magnetic body, the thin plate and the second magnetic body can be horizontally disposed. Also, the first magnetic body is attached to a lateral surface of the storage panel and the second magnetic body is attached to an opposed lateral surface of the guide panel.

It is preferable that the thin plate is fixed to the storage case. The storage panel can have a wheel. Further, the slide rail has a slot accommodating the wheel and the magnetic damper Also, a magnetic damper for the storage panel guide may be provided. The magnetic damper of the present invention may comprise: a first magnetic body and a second magnetic body opposed to the first magnetic body, wherein a magnetic attractive force acts therebetween; and a thin plate interposed between the first magnetic body and the second magnetic body. The first and second magnetic bodies can be permanent magnets. Further, the first and second magnetic bodies can apply a magnetic attractive force to each other. Alternatively, the first magnetic body is a permanent magnet and the second magnetic body is a ferromagnetic substance on which a magnetic attractive force acts by the first magnetic body. Otherwise, the second magnetic body is a permanent magnet and the first magnetic body is a ferromagnetic substance on which a magnetic attractive force acts by the second magnetic body.

Moreover, an ultrasonic diagnostic system having a storage panel guiding device with a magnetic damper may be provided. The ultrasonic diagnostic system of the present invention comprises a storage panel guiding device, an ultrasonic diagnostic apparatus and a storage case. The storage panel guiding device includes a magnetic damper, a storage panel, a guide panel and a slide rail having a slot. The magnetic damper has a first magnetic body, a second magnetic body opposed to the first magnetic body, and a thin plate interposed therebetween. A magnetic attractive force may act between the first and second magnetic bodies. The first magnetic body is attached to the storage panel. The second magnetic body is attached to the guide panel moving in the slot. The ultrasonic diagnostic apparatus is placed on the storage panel. The slide rail is provided in the storage case. The storage case accommodates the storage panel guiding device and the ultrasonic diagnostic apparatus.

Any reference in this specification to "one embodiment," "an embodiment," "example embodiment," etc., means that a particular feature, structure or characteristic described in connection with the embodiment is included in at least one embodiment of the present invention. The appearances of such phrases in various places in the specification are not necessarily all referring to the same embodiment. Further, when a particular feature, structure or characteristic is described in connection with any embodiment, it is submitted that it is within the purview of one skilled in the art to effect such feature, structure or characteristic in connection with other ones of the embodiments.

Although embodiments have been described with reference to a number of illustrative embodiments thereof, it should be understood that various other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A storage panel guiding device, comprising:

a magnetic damper including a first magnetic body, a second magnetic body opposed to the first magnetic body and a thin plate interposed therebetween and contacted to the first and second magnetic bodies, wherein a magnetic attractive force acts between the first and second magnetic bodies;

a storage panel to which the first magnetic body is attached;

a guide panel to which the second magnetic body is attached;

a slide rail having a slot in which the guide panel moves; and a storage case for accommodating the magnetic damper, the storage panel and the guide panel, wherein the slide rail is provided in the storage case, wherein the thin plate is fixed to the storage case and the storage panel and the guide panel are movable relative to the storage case.

2. The storage panel guiding device of claim 1, wherein the first magnetic body, the thin plate and the second magnetic body are vertically disposed, and wherein the first magnetic body is attached to a bottom surface of the storage panel and the second magnetic body is attached to a top surface of the guide panel.

3. The storage panel guiding device of claim 1, wherein the first magnetic body, the thin plate and the second magnetic body are horizontally disposed, and wherein the first magnetic body is attached to a lateral surface of the storage panel and the second magnetic body is attached to an opposed lateral surface of the guide panel.

4. The storage panel guiding device of claim 1, wherein the storage panel has a wheel, and wherein the slide rail has a slot accommodating the wheel and the magnetic damper.

5. The storage panel guiding device of any one of claims 1 to 3 and 4, wherein the first and second magnetic bodies are permanent magnets, and wherein the first and second magnetic bodies apply a magnetic attractive force to each other.

6. The storage panel guiding device of any one of claims 1 to 3 and 4, wherein the first magnetic body is a permanent magnet, and wherein the second magnetic body is a ferromagnetic substance on which a magnetic attractive force act by the first magnetic body.

7. The storage panel guiding device of any one of claims 1 to 3 and 4, wherein the second magnetic body is a permanent magnet, and wherein the first magnetic body is a ferromagnetic substance on which a magnetic attractive force act by the second magnetic body.

8. An ultrasonic diagnostic system comprising a storage panel guiding device, an ultrasonic diagnostic apparatus and a storage case, wherein the storage panel guiding device includes a magnetic damper, a storage panel, a guide panel and a slide rail having a slot, wherein the magnetic damper has a first magnetic body, a second magnetic body opposed to the first magnetic body, and a thin plate interposed therebetween and contacted to the first and second magnetic bodies, a magnetic attractive force acting between the first and second magnetic bodies, wherein the first magnetic body is attached to the storage panel, wherein the second magnetic body is attached to the guide panel moving in the slot, wherein the ultrasonic diagnostic apparatus is placed on the storage panel, wherein the slide rail is provided in the storage case, wherein the storage case accommodates the storage panel guiding device and the ultrasonic diagnostic apparatus, and wherein the thin plate is fixed to the storage case and the first magnetic body and the second magnetic body are movable relative to the thin plate.

* * * * *